US006325418B1

(12) United States Patent
Lenhart

(10) Patent No.: US 6,325,418 B1
(45) Date of Patent: Dec. 4, 2001

(54) POLE GRIP WITH WRIST STRAP

(76) Inventor: Klaus Lenhart, Mittlerer Weg 23, D-73230 Ohmden (DE)

( * ) Notice: Subject to any disclaimer, the term of this patent is extended or adjusted under 35 U.S.C. 154(b) by 0 days.

(21) Appl. No.: 09/525,937

(22) Filed: Mar. 15, 2000

(30) Foreign Application Priority Data

Mar. 15, 1999 (DE) ..... 299 04 591 U

(51) Int. Cl.[7] ..... A63C 11/22
(52) U.S. Cl. ..... 280/821; 280/822
(58) Field of Search ..... 280/822, 821; 16/428, 422, 436; 24/508.11, 633, 637, 643, 644

(56) References Cited

U.S. PATENT DOCUMENTS

| | | | | |
|---|---|---|---|---|
| 3,560,014 | * | 2/1971 | Bruckl | 280/11.37 |
| 4,288,100 | * | 9/1981 | Aho | 280/821 |
| 4,779,896 | * | 10/1988 | Ingalls | 280/821 |
| 5,312,134 | * | 5/1994 | Goode et al. | 280/822 |
| 5,443,287 | | 8/1995 | Wells | 280/822 |
| 5,549,330 | * | 8/1996 | Goode et al. | 280/822 |

FOREIGN PATENT DOCUMENTS

| | | |
|---|---|---|
| 8101226 | 1/1981 | (DE) . |
| 19636852 C1 | 12/1998 | (DE) . |

* cited by examiner

*Primary Examiner*—Brian L. Johnson
*Assistant Examiner*—Tony Winner
(74) *Attorney, Agent, or Firm*—Jones, Tullar & Cooper, P.C.

(57) ABSTRACT

A pole grip for releasably locking a wrist strap to the pole grip, the pole grip being, in particular, for cross-counting ski poles includes is a first connecting element that is fixed to the wrist wrap, a second connecting element cooperating with the first connecting element provided in a pole grip recess and is movable counter to a resilent bearing by means of an actuating member that is accessible in the region of grip head of pole grip. The pole grip includes a body which defines the recess, an inlet and an outlet to the recess, with the inlet being dosposed in an approximately rectilinear alignment with the outlet in whose region the actuating member is actuable. The first connecting element being introduced and retracted relative to said inlet.

12 Claims, 2 Drawing Sheets

POLE GRIP WITH WRIST STRAP

BACKGROUND OF THE INVENTION

The present invention relates to a ski pole grip, in particular for cross-country poles, having a wrist strap, which is releasably lockable to the pole grip via a first connecting element that is fixed to the wrist strap, and a second connecting element cooperating with the first connecting element, provided in a pole grip recess and movable counter to resilient bearing by means of an actuating member that is accessible in the region of the grip head.

In one such pole grip, known from German Patent DE 196 36 852 C1, the pole grip recess is accessible from a circumferential side for the first connecting element solidly connected to the wrist strap, and is covered on the face end of the grip head by a release cap and the actuating member. The actuating member is movable in the axial direction of the pole grip and is coupled with the second connecting element for the sake of axial motion of the second connecting element. In this known pole grip, the inlet and outlet of the pole grip recess are accordingly disposed perpendicular to one another, which is appropriate in designing downhill ski poles, in particular, since the pole grips for such poles are typically provided with a slightly curved grip head face end extending substantially perpendicular to the axis of the pole.

OBJECT AND SUMMARY OF THE INVENTION

The object of the present invention is to provide a pole grip of the type defined at the outset whose releasable wrist strap fastening is adapted to the preferably slenderer forms of cross-country ski pole grips and is released in a structurally simpler way.

To attain this object, in a pole grip of the type defined at the outset, the inlet to the pole grip recess into and out of which the first connection element can be introduced and retracted, is disposed in an approximately rectilinear alignment with the outlet of the pole grip recess, in whose region the actuating member is actuatable.

By the provisions according to the invention, because of the approximately rectilinear alignment, a structurally simpler capability of releasable locking of the two connecting elements inside the pole grip recess is obtained. Moreover, the face end of the grip head of the cross-country ski pole can be designed in a more versatile way.

By disposing the pole grip recess at an acute angle to the longitudinal axis of the pole grip, or of the pole tube connected to it, or by providing the inlet to the pole grip recess on a circumferential region and providing the outlet of the pole grip recess on a leveled grip head end of the pole grip; or protruding the actuating member past the outlet of the pole grip recess, it is attained that the capability of locking the wrist strap in the pole grip does not increase the diameter of the pole grip; that is, the pole grip can be kept very slender. Nevertheless, designing the upper free end of the pole grip is advantageously possible.

Advantageous handling of the release of the locking is obtained if the by forming the actuating member as a lever pivotably supported in the pole grip recess. The actuating lever is disposed on the one hand in such a way that it cannot be actuated unintentionally, yet nevertheless in such a way that one-hand operation is possible.

Advantageous and simple constructive provisions are obtained from the emboding the actuating member as a lever and forming it and the second connecting element as, one piece, or by pivotably connecting the actuating lever between the pivot axis and the outlet of the pole grip recess with a spring, or by providing a spring which is based on an inner wall region of the pole grip and which presses the actuating member against a wall region of the pole grip that defines the outlet of the pole grip recess.

Advantageous features of the connecting elements and their disposition inside the pole grip recess are realized in that the first and second connecting elements are provided with lugs that interests with one another, or in that the first connecting element, in the state in which it is thrust into the pole grip recess is braked on an inner guide face of the pole grip, or in that the inner guide face is provided with a stop.

Further details of the invention can be learned from the ensuing descriptions, in which the invention is described and explained in further detail in terms of the exemplary embodiment shown in the drawing.

DESCRIPTION OF THE PREFERRED EMBODIMENT

Figure 1:
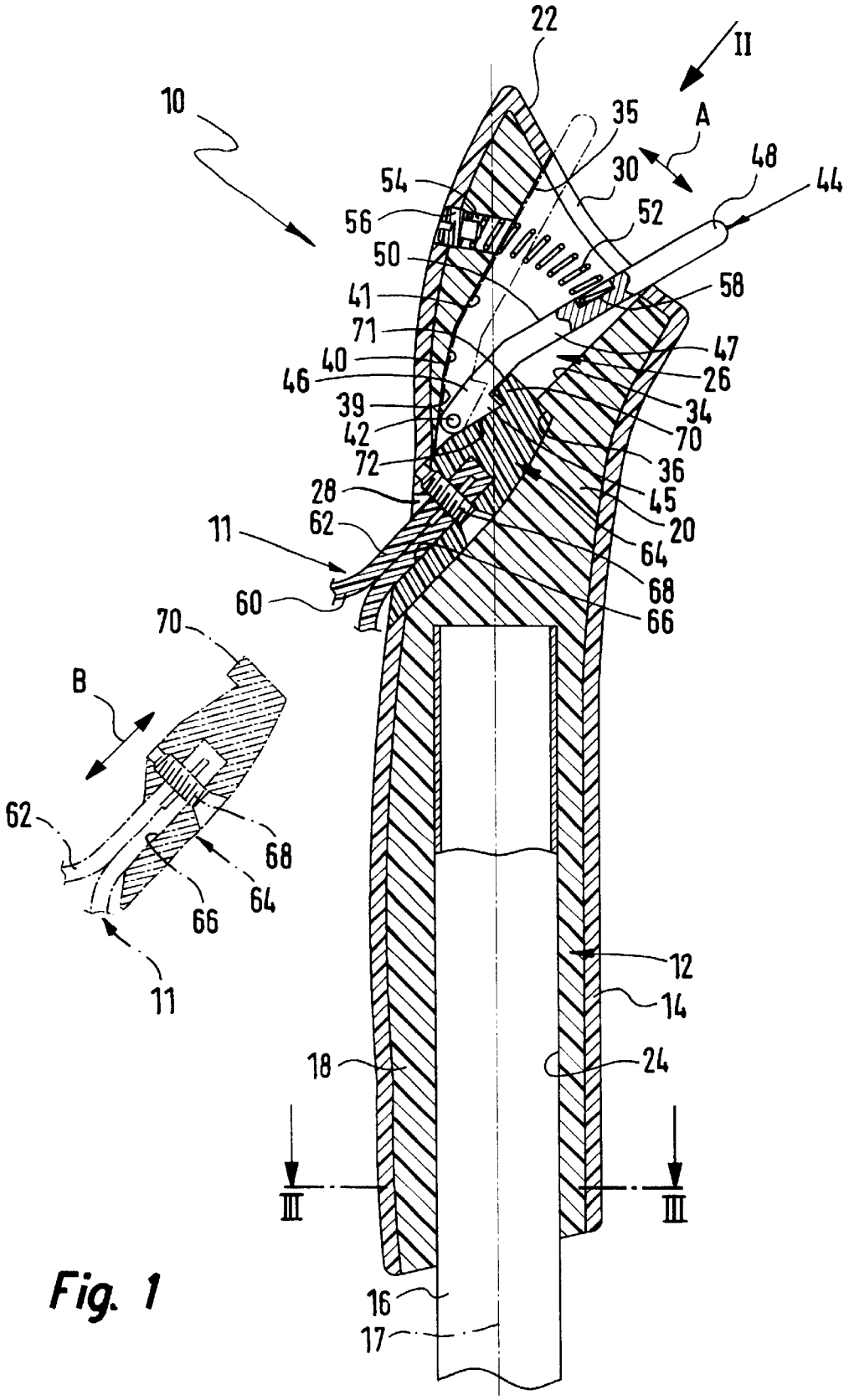
FIG. 1, is a longitudinal section, partly truncated, showing a pole grip with a wrist strap that can be snapped in releasably, in accordance with a preferred exemplary embodiment of the present invention.

The pole grip 10 shown in the drawing in terms of a preferred exemplary embodiment has a base body 12, made for instance from a plastic injection-molded part. The base body 12 may, as shown in the drawing, be provided with a sheath 14 of material suitable for a hand grip. The pole grip 10 is slipped onto and over a pole tube 16 of a cross-country ski pole and is solidly joined to it, preferably being adhesively bonded or pressed onto it.

Figure 2:
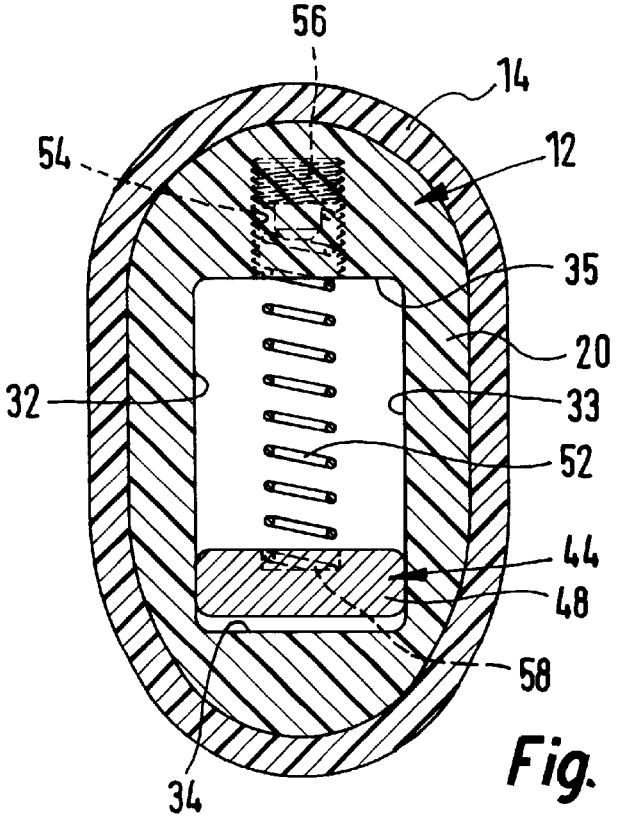
FIG. 2 is a view, partly in section, in the direction of arrow II of FIG. 1.
Figure 3:
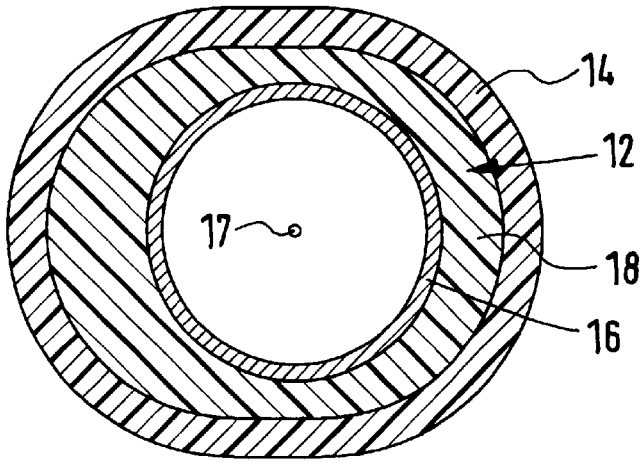
FIG. 3 is a section taken along the line III—III of FIG. 1.

The base body 12 of the pole grip 10 is embodied approximately cylindrically in a lower region 18, but is disposed eccentrically to the longitudinal axis 17 of the pole tube 16, as can be best seen from FIG. 3. The upper end region 20 of the base body 12 of the pole tube 10 is conversely provided with an approximately oval form in end view as seen in FIG. 2, which in a manner not shown changes over continuously in a middle region, approximately below the free end of the pole tube 16, into the cylindrical shape. The upper end region 20 is inclined in a lateral direction relative to the longitudinal axis 17 as shown in FIG. 1; the short sides of the oval form are slightly curved. The end of this upper region 20 has an end head face 22, which in the direction of its narrow dimension extends straight and in the direction of its longer dimension is curved slightly concavely, and extends at an acute angle to the longitudinal axis 17.

Aside from and axial cylindrical hollow chamber 24 in the lower end region 18 for receiving the end of the pole tube 16, the base body 12 has a recess 26 in the upper end region 20, specifically at a specific spacing above this cylindrical hollow chamber 24, that is embodied substantially rectangularly with different cross sections. The width of the recess 26 is approximately the same, while its height is in part graduated and in part widens in fanlike fashion. The recess 26 extends from a substantially rectangular inlet 28, which is provided on a short side of the base body 12, to a substantially likewise rectangular outlet 30, which is located in the obliquely extending end face 22 of the grip head.

Since the access opening 28 is located in a region somewhat above the bottom of the cylindrical hollow chamber 24 in the base body 12, the recess 26 extends in a direction that is at an acute angle to the orientation of the longitudinal axis 17.

As mentioned, side faces 32 and 33 that define the recess 26 extend substantially parallel between the access opening 28 and the outlet opening 30. By comparison, a stepped bottom face 34 that defines the recess 26 extends from the access opening 28 slightly concavely inward and forms a step at a stop face 36, facing toward the access opening 28, after which it extends straight in approximately the same direction to the outlet opening 30. A top face 35 that defines the recess 26 extends at such an angle to the bottom face 34 that the recess 26 widens from the access opening 28 to the outlet opening 30. The top face 35 extends relatively steeply in a first and second portion 39, 40 and more shallow in a third portion 41 toward the outlet opening; all the portions 39, 40, 41 are straight.

Inside the recess 26, near the first portion 39 of the top face 35, a pivot axis 42 is defined, which is retained in the base body 12 and traverses the recess 26 between the side faces 32 and 33. A one-armed lever 44 is pivotably connected by its one end 46 at the pivot axis 42, while the free end 48 of the lever 44 protrudes out of the outlet opening 30 of the recess 26. This actuation end 48 is connected at an obtuse angle to the inner end 46 via an intermediate part 47. The outside 50 of the lever 44, which is oriented toward the top face 35, corresponds in its course to the top face 35.

The lever 44 is acted upon by a compression spring 52, one end of which extends inside the recess 26 at the intermediate part 47 of the lever 44 and the other end of which extends into a bore 54, originating at the top face 35, and is braced on a stop formed in this exemplary embodiment by a screw 56 introduced from outside into the base body 12. The compression spring 52, which has a somewhat curved course and which in the lever 44 extends into a blind bore 58, prestresses the lever into a position of repose, in which the actuation end 48 presses against the bottom face 34 at the outlet opening 30. The lever 44 is pivotable about the axis 42 as indicated by the double arrow A; the pivoting is limited by the top face 35.

A wrist strap 11 is releasably lockable to the pole grip 10; of the wrist strap, FIG. 1 shows only the fastening portion 62 of a strap 60. A connecting element 64, which is somewhat cleatlike and is made from a suitable plastic, has a slit 66 on its back side that receives the fastening portion 62 of the strap 11, which slit is penetrated by a pin or screw 68, retained in the fastening element 64, so that the strap 60 is solidly joined to the connecting element 64. The connecting element 64, which is approximately rectangular in cross section, has a unilaterally protruding detent lug 70 on its front end. At the lateral faces perpendicular to the detent lug 70, the front end of the connecting element 64 is designed slightly conically, for the sake of introduction into the access opening 28 of the recess 26. The external cross-sectional dimensions of the connecting element 64 match the internal cross-sectional dimensions of the access opening 28 of the recess 26, so that the connecting element 64 can be introduced into and retracted out of the recess 26, as indicated by the double arrow B and the positions represented by solid and dot-dash lines in FIG. 1, along with the strap 60 of the wrist strap 11 without substantial play yet still smoothly. For locking the connecting element 64 to the lever 44 inside the recess 26 of the base body 12 of the pole grip 10, the inner end 46 of the lever 44 is embodied as a counterpart detent element, with a sawtooth detent lug 45 protruding from the inside.

If the connecting element 64, retained on the wrist strap 11, is pushed out of the dot-dashed position of FIG. 1 through the access opening 28 into the recess 26 of the pole grip 10, the lug 70 slides with its face 71 along the sawtooth face 72 of the detent lug 45 of the lever 44 and, supporting itself on the bottom face 34, presses the lever 44 into a position equal to or near the dot-dashed position counter to the action of the compression spring 52. At the end of this introduction motion, that is, when the stop face 36 is reached by the connecting element 64, the detent lug 45 comes from of the connecting element 64 at the inner end 46, so that under the influence of the compression spring 52 the lever 44 is pressed into its outset position or position of repose represented by solid lines. As a result, locking of the connecting element 64 behind the detent end 46 of the lever 44 is achieved. A release of the locking is accomplished in correspondingly reverse order by moving the lever 44 out of its position of repose shown in solid lines into its release position shown in dot-dash lines, in which the wrist strap 11 can be pulled along with the connecting element 64 out of the recess 26. The detent release motion of the lever 44 can easily be accomplished with the index finger of one hand, for instance, while the hand is grasping the pole grip 10.

Although the recess 26 has been shown and described as extending at an acute angle to the longitudinal axis 17, it is understand that the recess 26 can also be disposed at an arbitrary other angle to the longitudinal axis 17.

What is claimed is:

1. A pole grip for releasably locking a wrist strap, comprising:

a first connecting element fixed to the wrist strap;

a pole grip body defining a recess, an inlet and outlet to said recess, and a grip head, a second connecting element cooperating with said first connecting element, said second connecting element having a first end and a second end, said second end being pivotably mounted in said pole grip recess adjacent said inlet;

a resilient bearing; and an actuating member accessible in the region of said grip head, wherein:

said first connecting element is introduced and retracted from said inlet;

said second connecting element being movable counter to said resilient bearing by means of said actuating member; and said inlet is disposed in an approximately rectilinear alignment with said outlet in whose region said actuating member is actuatable.

2. The pole grip as defined in claim 1, wherein said inlet is provided on a circumference region of said pole grip body, and wherein said outlet is provided on a beveled grip head end of said pole grip body.

3. The pole grip as defined in claim 1, wherein said actuating member protrudes past said outlet.

4. The pole grip as defined in claim 1, wherein said actuating member is formed as a lever pivotably supported in said pole grip recess.

5. The pole grip as defined in claim 4, wherein said actuating lever is pivotably connected at a pivot axis which passes through second connecting element.

6. The pole grip as defined in claim 1, wherein said actuating member is embodied as a lever and is formed in one piece with said second connecting element.

7. The pole grip as defined in claim 6, further comprising:

a spring, wherein said actuating lever is acted upon between the pivot axis and said outlet by said spring.

8. A pole grip as defined in claim 7, wherein said spring is a compression spring engageable with an inner wall region of said pole grip body, and presses said actuating member against a wall region of said pole grip body that defines said outlet.

9. The pole grip as defined in claim 1, wherein said first and second connecting elements are provided with lugs that interlock with one another.

10. The pole grip as defined in claim 1, wherein said pole grip body has an inner guide face, and wherein said first connecting element is braced on said inner guide face when thrust into said pole grip body.

11. The pole grip as defined in claim 10, wherein said inner guide face is provided with a stop.

12. A pole pole grip for releasably locking a wrist strap, comprising:

a first connecting element fixed to the wrist strap;

a pole grip body defining a longitudinal axis and a recess, an inlet and outlet to said recess, and a grip head, said recess being disposed at an acute angle to said longitudinal axis;

a second connecting element cooperating with said first connecting element, said second connecting element having a first end and a second end, said second end being pivotably mounted in said pole grip recess adjacent said inlet;

a resilient bearing; and an actuating member accessible in the region of said grip head, wherein:

said first connecting element is introduced and retracted from said inlet;

said second connecting element being movable counter to said resilient bearing by means of said actuating member; and said inlet is disposed in an approximately rectilinear alignment with said outlet in whose region said actuating member is actuatable.

* * * * *